US011222594B2

(12) United States Patent
Gai

(10) Patent No.: US 11,222,594 B2
(45) Date of Patent: Jan. 11, 2022

(54) DIGITAL PIXEL DRIVING CIRCUIT AND DIGITAL PIXEL DRIVING METHOD

(71) Applicant: Chengdu Vistar Optoelectronics Co., Ltd., Chengdu (CN)

(72) Inventor: Cuili Gai, Chengdu (CN)

(73) Assignee: CHENGDU VISTAR OPTOELECTRONICS CO., LTD., Chengdu (CN)

( * ) Notice: Subject to any disclaimer, the term of this patent is extended or adjusted under 35 U.S.C. 154(b) by 0 days.

(21) Appl. No.: 17/151,975

(22) Filed: Jan. 19, 2021

(65) Prior Publication Data

US 2021/0142729 A1 May 13, 2021

Related U.S. Application Data

(63) Continuation of application No. PCT/CN2019/093734, filed on Jun. 28, 2019.

(30) Foreign Application Priority Data

Dec. 14, 2018 (CN) ..... 201811533827.3

(51) Int. Cl.
*G09G 3/3233* (2016.01)
*G09G 3/3258* (2016.01)
(Continued)

(52) U.S. Cl.
CPC ..... *G09G 3/3258* (2013.01); *G09G 3/2092* (2013.01); *G09G 3/3266* (2013.01); *G09G 3/3291* (2013.01); *G09G 2330/12* (2013.01)

(58) Field of Classification Search
CPC .. G09G 3/3258; G09G 3/2092; G09G 3/3266; G09G 3/3291; G09G 2330/12;
(Continued)

(56) References Cited

U.S. PATENT DOCUMENTS 6,961,032 B2 11/2005 Winters
10,510,296 B2 * 12/2019 Chen ..... H01L 27/3244
(Continued)

FOREIGN PATENT DOCUMENTS

CN 1698084 A 11/2005
CN 103594059 A 2/2014
(Continued)

OTHER PUBLICATIONS

International Search Report dated Sep. 20, 2019 in corresponding International Application No. PCT/CN2019/093734; 7pages.
(Continued)

*Primary Examiner* — Jose R Soto Lopez
(74) *Attorney, Agent, or Firm* — Maier & Maier, PLLC

(57) ABSTRACT

A digital pixel driving circuit and a digital pixel driving method. The digital pixel driving circuit includes a pixel driving module, a display module, a storage module and a short-circuiting module. An output terminal of the pixel driving module is electrically connected to an input terminal of the display module, and a control terminal of the pixel driving module is electrically connected to any output terminal of the storage module. An input terminal of the short-circuiting module is electrically connected to the input terminal of the display module, an output terminal of the short-circuiting module is electrically connected to an output terminal of the display module, and a control terminal of the short-circuiting module is electrically connected to any output terminal of the storage module.

10 Claims, 9 Drawing Sheets

(51) Int. Cl.
*G09G 3/20* (2006.01)
*G09G 3/3266* (2016.01)
*G09G 3/3291* (2016.01)

(58) Field of Classification Search
CPC ..... G09G 3/2018; G09G 2300/0857; G09G 3/32; G09G 3/3225
See application file for complete search history.

(56) References Cited

U.S. PATENT DOCUMENTS

2002/0084463 A1* 7/2002 Sanford ..... G09G 3/3233 257/82
2003/0141504 A1* 7/2003 Kuwabara ..... H01L 29/78648 257/66
2005/0259703 A1* 11/2005 You ..... G09G 3/3233 372/38.07
2008/0180364 A1* 7/2008 Kim ..... G09G 3/3233 345/76
2009/0096725 A1* 4/2009 Kretz ..... G09G 3/3233 345/82
2011/0181630 A1* 7/2011 Smith ..... G09G 3/3283 345/690
2013/0222440 A1* 8/2013 Ikeda ..... H05B 33/08 345/690
2013/0300724 A1* 11/2013 Chaji ..... G09G 3/3283 345/212
2015/0379956 A1* 12/2015 Nonaka ..... G09G 3/325 315/172
2016/0189604 A1* 6/2016 Hu ..... G09G 3/3225 345/215
2017/0236470 A1* 8/2017 Miki ..... G09G 3/3258 345/690
2017/0301290 A1* 10/2017 Qing ..... G09G 3/3233
2019/0066587 A1* 2/2019 Han ..... H01L 27/1218
2019/0156747 A1* 5/2019 Nie ..... G09G 3/3266
2019/0318691 A1* 10/2019 Soni ..... G09G 3/3233
2020/0051500 A1* 2/2020 Lin ..... G09G 3/3258
2020/0410925 A1* 12/2020 Hu ..... G09G 3/3275
2021/0005138 A1* 1/2021 Umezawa ..... G09G 3/3233
2021/0158753 A1* 5/2021 Geng ..... G09G 3/3233

FOREIGN PATENT DOCUMENTS

CN 104064140 A 9/2014
CN 104103239 A 10/2014
CN 104575380 A 4/2015
CN 105590580 A 5/2016
CN 105654904 A 6/2016
CN 105845085 A 8/2016
CN 106469539 A 3/2017
CN 106847188 A 6/2017
CN 107507564 A 12/2017

OTHER PUBLICATIONS

Office Action dated Dec. 21, 2020 in Chinese Application No. 201811533827.3; 10 pages including English-language translation.

* cited by examiner

DIGITAL PIXEL DRIVING CIRCUIT AND DIGITAL PIXEL DRIVING METHOD

CROSS REFERENCE TO RELATED APPLICATIONS

The present disclosure is a continuation of international application No. PCT/CN2019/093734 filed on Jun. 28, 2019, and claims priority of a Chinese patent application No. 201811533827.3, entitled "Digital Pixel Driving Circuit and Digital Pixel Driving Method" and filed on Dec. 14, 2018, which are incorporated herein by reference in its entirety.

FIELD

The present disclosure relates to the technical field of display, in particular to a digital pixel driving circuit and a digital pixel driving method.

BACKGROUND

At present, common pixel circuits are divided into an analog pixel driving circuit and a digital pixel driving circuit. However, there are some problems in the analog pixel driving circuit, such as high circuit power consumption, susceptibility to signal interferences, high dependence on drive device consistency or a compensation circuit, etc. The digital pixel driving circuit has advantages of low power consumption, less susceptibility to signal interferences, high tolerance to the consistency of the drive device, etc.

SUMMARY

Some embodiments of the present disclosure are intended to provide a digital pixel driving circuit and a digital pixel driving method, so that a level signal can accurately control a light emitting component in a display screen to emit light and improve display effect of the display screen.

Some embodiments of the present disclosure provide a digital pixel driving circuit, which includes a pixel driving module, a display module, a storage module and a short-circuiting module. An input terminal of the pixel driving module is electrically connected to a display voltage, an output terminal of the pixel driving module is electrically connected to an input terminal of the display module, and a control terminal of the pixel driving module is electrically connected to any output terminal of the storage module. An input terminal of the short-circuiting module is electrically connected to the input terminal of the display module, an output terminal of the short-circuiting module is electrically connected to an output terminal of the display module, and a control terminal of the short-circuiting module is electrically connected to any output terminal of the storage module. The storage module is configured to buffer a level signal input from a data line and output the level signal. When the level signal indicates the display module to turn off, the short-circuiting module short-circuits the input terminal of the display module and the output terminal of the display module; and when the level signal indicates the display module to display, the pixel driving module drives the display module to display.

Some embodiments of the present disclosure further provide a digital pixel driving method, which is applied to the above-mentioned digital pixel driving circuit. The digital pixel driving method specifically includes: the storage module buffers the level signal input from the data line. When the level signal indicates the display module to display, the pixel driving module drives the display module to display according to the level signal. When the level signal indicates the display module to turn off, the short-circuiting module short-circuits the input terminal and the output terminal of the display module according to the level signal.

Since there is a current leakage in the digital pixel driving circuit, when the level signal indicates the display module to turn off, the display module still displays to decrease the display efficiency of the display module. However, in these embodiments, the input terminal of the display module is electrically connected to the input terminal of the short-circuiting module, and the output terminal of the display module is electrically connected to the output terminal of the short-circuiting module. When the level signal indicates the display module to turn off, the short-circuit module short-circuits both the input terminal and the output terminal of the display module, so that even if there is a current leakage in the digital pixel driving circuit, the display module may not be driven to display, thus the display module can accurately display according to the indication of the level signal to improve the display performance of the digital pixel driving circuit. Moreover, since the display may be strictly performed according to the indication of the level signal, the display effect may not be affected due to the leakage current when an input voltage is increased or decreased, and then the display effect (such as a brightness value) of the display module may be adjusted by adjusting the input voltage, thereby further improving the accurate control of the display module.

DETAILED DESCRIPTION

The applicant finds that there are at least the following problems in the existing technology: in the current digital pixel driving circuit, during the process of driving an organic light-emitting diode (OLED) by a level signal, the OLED still emits light under a condition that the level signal indicates the OLED not to emit light, causing the level signal not to be able to completely control the light-emitting state of the OLED and affecting the display effect.

In order to make the purpose, the technical solution and the advantages of the present disclosure clearer, some embodiments of the present disclosure are explained below in detail with reference to the accompanying drawings and embodiments. It should be understood that the specific embodiments described here only explain the present disclosure but do not limit the present disclosure.

An embodiment of the present disclosure relates to a digital pixel driving circuit. The digital pixel driving circuit is applied to a display device which may be a product or a component with a display function such as a mobile phone, a tablet computer, a television, a display, a laptop, a digital photo frame or a navigator. The digital pixel driving circuit includes a pixel driving module 101 (or a pixel driving circuit), a display module 102 (or a display element), a storage module 103 (or a memory) and a short-circuiting module 104 (or a short-circuiting circuit). The connection relationship between each component is shown in FIG. 1.

Figure 1:
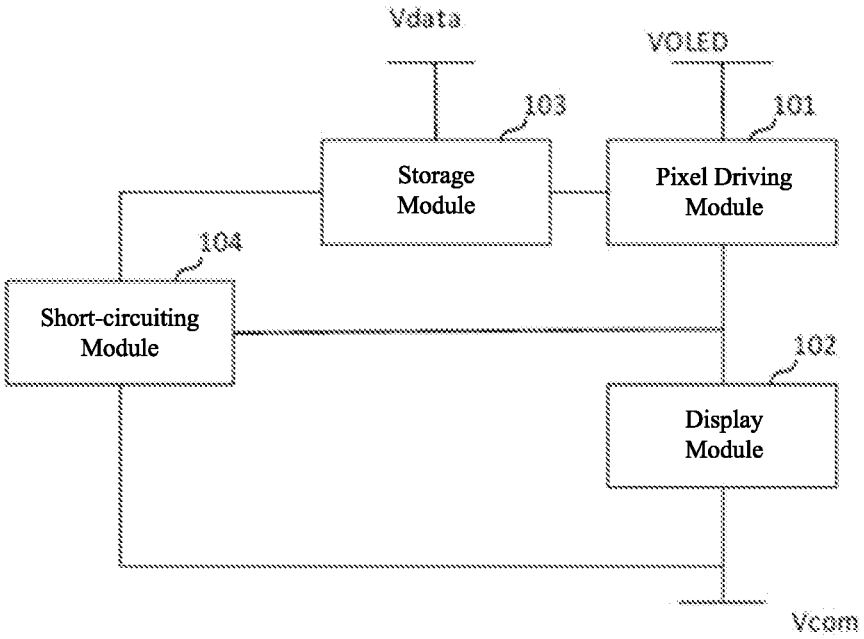
FIG. 1 is a schematic diagram illustrating connection of various elements in a digital pixel driving circuit according to the present disclosure.

An input terminal of the pixel driving module 101 is electrically connected to a display voltage (VOLED as shown in FIG. 1), an output terminal of the pixel driving module 101 is electrically connected to an input terminal of the display module 102, and a control terminal of the pixel driving module 101 is electrically connected to any one of the output terminals of the storage module 103. An input terminal of the short-circuiting module 104 is electrically connected to the input terminal of the display module 102, an output terminal of the short-circuiting module 104 is electrically connected to an output terminal of the display module 102, and a control terminal of the short-circuiting module 102 is electrically connected to any one of the output terminals of the storage module 103. The storage module 103 is configured to buffer a level signal input from a data line and output the level signal. When the level signal indicates the display module 102 to turn off, the short-circuiting module 104 short-circuits the input terminal and the output terminal of the display module 102. When the level signal indicates the display module 102 to display, the pixel driving module 101 drives the display module 102 to display. In FIG. 1, the data line is represented by Vdata, and a negative voltage is represented by Vcom.

Specifically, the pixel driving module 101 may be a driving transistor 101. Here, the driving transistor 101 may be an N-type Thin Film Transistor (referred to as "TFT") or a P-type TFT. The specific choice of the N-type TFT or the P-type TFT may be made according to actual requirements of circuit design. Similarly, the short-circuiting module 104 may be a switching transistor 104. The switching transistor 104 may be the N-type TFT or the P-type TFT. A drain of the driving transistor 101 is electrically connected to the output terminal of the display module 102. When the driving transistor 101 is turned on, the display module 102 is driven to display. The display module 102 may be an organic light emitting diode or a light emitting diode (i.e., OLED/LED), or an AMOLED, etc. Since leakage current generated by the N-type TFT is small, the N-type TFT is adopted in this embodiment.

The digital pixel driving circuit involves two time periods, that is, a data writing period and a luminous time period. Within the data writing period, the storage module 103 writes a signal input from the data line when a scanning signal is valid. During the luminous time period, the scanning signal is invalid, and the pixel driving module 101 reads the level signal from the output terminal of the storage module 103. The data line inputs the level signal for indicating display or display off of the display module.

The valid scanning signal and the invalid scanning signal may be determined according to actual applications, for example, the scanning signal may be determined as valid either when a scanning line outputs a high level signal or the scanning line outputs a low level signal.

The storage module 103 may be a circuit structure of a static random-access memory (referred to as "SRAM"). The storage module 103 is electrically connected to the data line and the scanning line. The storage module 103 stores the level signal according to the scanning signal output from the scanning line; or the storage module 103 outputs the level signal and an inverted level signal according to the scanning signal, where the inverted level signal is inverted to the level signal.

Figure 2:
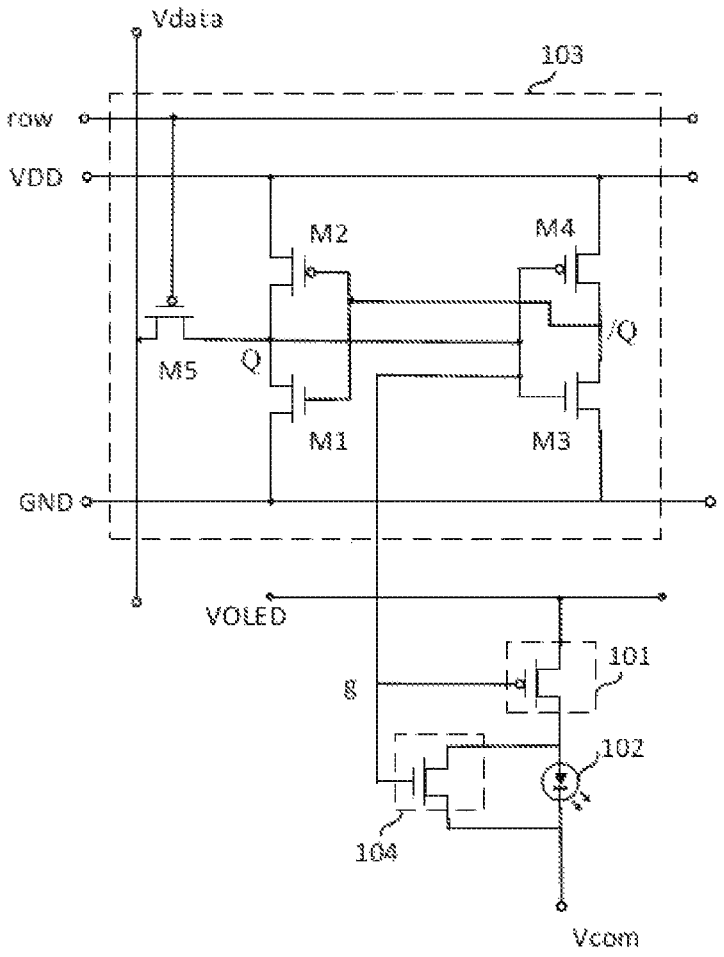
FIG. 2 is a specific circuit schematic diagram of the digital pixel driving circuit according to the present disclosure.

In a specific embodiment as shown in FIG. 2, the storage module 103 may include five or six transistors. In this embodiment, five transistors are selected to form the storage module 103. A transistor M1, a transistor M2, a transistor M3, and a transistor M4 form a cross-coupled inverter, and a transistor M5 is served as a control switch for controlling the data line to write the level signal.

In a specific embodiment, the digital pixel driving circuit is shown in FIG. 2, where the driving transistor 101 is a P-type TFT and the switching transistor is an N-type TFT. A gate of the driving transistor 101 is electrically connected to a first output terminal (a terminal Q in FIG. 2) of the storage module 103, a gate of the switching transistor 104 is electrically connected to the first output terminal, and the first output terminal of the storage module 103 outputs the level signal, where the driving transistor 101 is turned on when the level signal indicates the display module 102 to display. When the level signal indicates the display module 102 to display, the level signal controls the switching transistor 104 to be in an off state through the gate of the switching transistor 104. When the level signal indicates the display module 102 to turn off, the level signal controls the switching transistor 104 to be in an on state through the gate of the switching transistor 104 to short-circuit the input terminal and the output terminal of the display module 102.

Specifically, since the driving transistor 101 is turned on when the level signal indicates the display module 102 to display, and the switching transistor 104 is turned on when the level signal indicates the display module 102 to turn off, the conduction condition of the driving transistor 101 is opposite to that of the switching transistor 104. That is, if the driving transistor 101 is a P-type TFT, then the switching transistor 104 is an N-type TFT; and if the driving transistor 101 is an N-type TFT, then the switching transistor 104 is a P-type TFT.

The gate of the driving transistor 101 is electrically connected to the first output terminal of the storage module 103, a source of the driving transistor 101 is electrically connected to the display voltage VOLED, the drain of the driving transistor 101 is electrically connected to the input terminal of the display module 102, the output terminal of the display module 102 is electrically connected to the negative voltage (Vcom in FIG. 2). The gate of the switching transistor 104 is electrically connected to the first output terminal of the storage module 103, a source of the switching transistor 104 is electrically connected to the input terminal of the display module 102, and a drain of the switching transistor 104 is electrically connected to the output terminal of the display module 102. The first output terminal of the storage module 103 outputs the level signal. The level signal controls the switching transistor 104 to be in the off state when the level signal turns on the driving transistor 101.

The working process of the digital pixel driving circuit is described in detail below with reference to FIG. 2 and FIG. 3. Here, in FIG. 3, the number "0" represents a state timing when Vdata is at the high level, and the number "1" represents the state timing when Vdata is at the low level. T1 represents the data writing period in the state where the level signal is high. T2 represents the luminous time period in the state where the level signal is high. T3 represents the data writing period in the state where the level signal is low. T4 represents the luminous time period in the state where the level signal is low.

Figure 3:
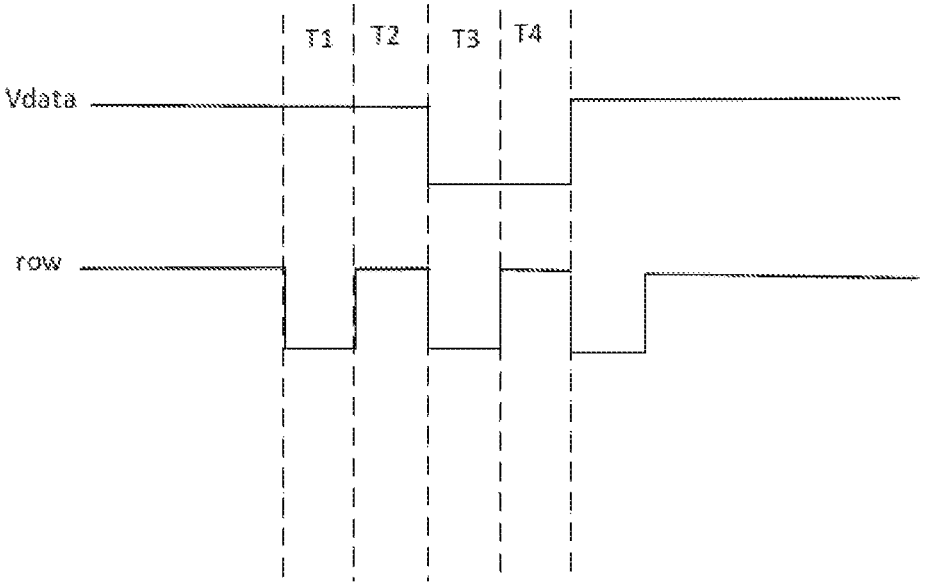
FIG. 3 is an operating timing diagram of the digital pixel driving circuit according to the present disclosure.

For example, assuming that the number "1" indicates the display module to display, then within the data writing period (T3 in FIG. 3), the scanning signal is at the low level, i.e., row in FIG. 3 is at the low level, and the voltage of the level signal output from the data line is low, i.e., Vdata in FIG. 3 is at the low level. As shown in FIG. 2, the transistor M5 is turned on and the point Q has a low voltage, thus the transistor M4 is turned on and the transistor M3 is turned off. A point /Q is electrically connected to VDD, so that the voltage at the point /Q is equal to the voltage of VDD, i.e., the point /Q is at the high level. Since point g and point Q are the same point with the same voltage, then point g is at a low level, the driving transistor 101 is turned on, and the switching transistor 104 is turned off, so that the OLED emits light. Within the luminous time period (T4 in FIG. 3), the scanning signal is at the high level, i.e., row is at the high level in FIG. 3, then the transistor M5 is in the off state. The point Q is electrically connected to a ground line, that is, the point Q and the point g are at the low level, then the driving transistor 101 continues to be turned on, the switching transistor 104 continues to be in the off state, and the OLED continues to emit light.

The number "0" indicates the display module to turn off, then within the data writing period (T1 in FIG. 3), the scanning signal is at the low level, i.e., row in FIG. 3 is at the low level. The level signal output from the data line is at the high level, i.e., Vdata in FIG. 3 is at the high level. The transistor M5 is turned on and the voltage at point Q is high, thus the transistor M3 is turned on and the transistor M4 is turned off. The point /Q is electrically connected to the ground (GND), so that the voltage of the point /Q is equal to the voltage of GND, i.e., the point /Q is at the low level. Then the transistor M2 is turned on, causing the point Q to be electrically connected to VDD. The point Q and the point g are at the high level, the driving transistor 101 is turned off, and the switching transistor 104 is turned on, so that the OLED does not emit light. Within the luminous time period (T2 in FIG. 3), the scanning signal is at the high level, i.e., row is at the high level in FIG. 3, then the transistor M5 is in the off state. The point Q is electrically connected to a VDD line, that is, the point Q and the point g are at the high level. Then the driving transistor 101 continues to be in the off state, the switching transistor 104 continues to be in the on state, and the OLED continues not to emit light.

Figure 4:
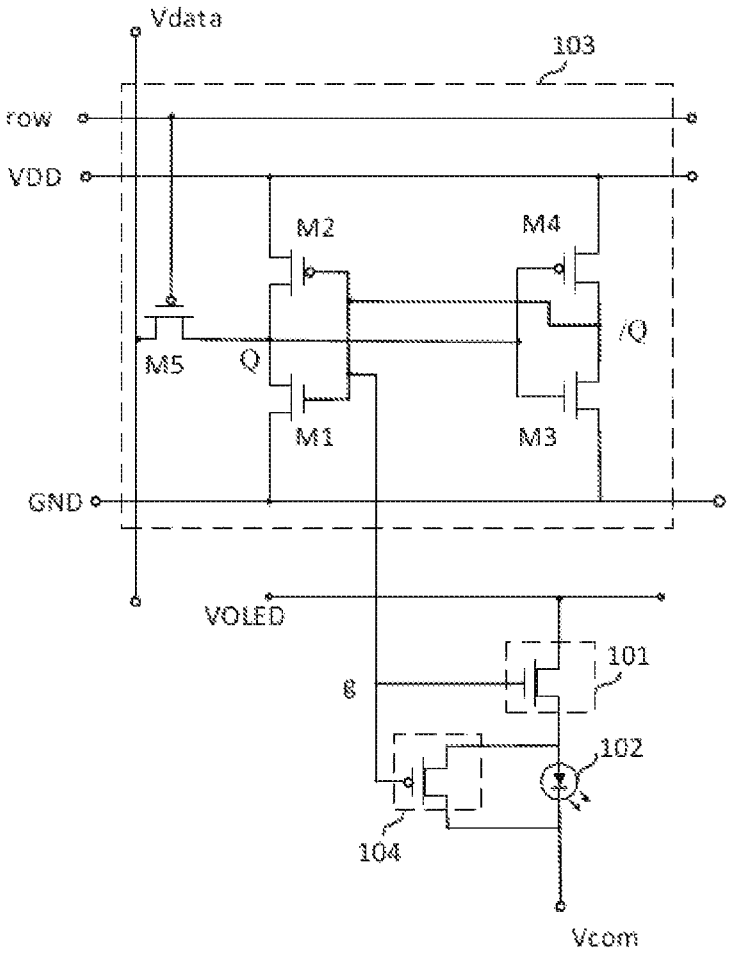
FIG. 4 is an another specific circuit schematic diagram of the digital pixel driving circuit according to the present disclosure.

In another specific embodiment, the digital pixel driving circuit is shown in FIG. 4. Here, the driving transistor 101 is an N-type TFT, and the switching transistor 104 is a P-type TFT. The gate of the driving transistor 101 is electrically connected to a second output terminal, i.e., point /Q in FIG. 4, of the storage module. The gate of the switching transistor 104 is electrically connected to the second output end of the storage module. The second output terminal of the storage module 103 outputs an inverted level signal opposite to the level signal. When the level signal indicates the display module 102 to display, the driving transistor 101 is turned off, and the inverted level signal controls the switching transistor 104 to be turned off through the gate of the switching transistor 104. When the level signal indicates the display module 102 to turn off, the inverted level signal controls the switching transistor 104 to be turned on through the gate of the switching transistor 104 to short-circuit the input terminal and the output terminal of the display module 102.

The working principle of the digital drive pixel circuit is explained by taking a specific example as below. For example, assuming that the number "1" indicates the display module to display, then within the data writing period, the scanning signal, i.e., the signal output from the row line in FIG. 4, is at the low level. The voltage of the level signal output from the data line (Vdata in FIG. 4) is low. As shown in FIG. 4, the transistor M5 is turned on and the voltage at point Q is low, thus the transistor M4 is turned on and the transistor M3 is turned off. The point /Q is electrically connected to the VDD line, so that the voltage at the point /Q is equal to the voltage on VDD, i.e., the point /Q is at the high level. Since point g and point /Q are the same point with the same voltage, then point g is at the high level. The driving transistor 101 is turned on, and the switching transistor 104 is turned off, so that the OLED emits light. Within the luminous time period, the scanning signal is at the high level, then the transistor M5 is in the off state. The point Q is electrically connected to GND, that is, the point Q is at the low level. The point /Q and the point g are at the high level. The driving transistor 101 continues to be turned on, the switching transistor 104 continues to be in the off state, and the OLED continues to emit light.

The number "0" indicates the display module to turn off, then within the data writing period, the scanning signal is at the low level, the level signal output from the data line is at the high level. The transistor M5 is turned on and the point Q has a high voltage, thus the transistor M3 is turned on and the transistor M4 is turned off. The point /Q is electrically connected to GND, so that the voltage at the point /Q is equal to the voltage of GND, i.e., the point /Q is at the low level. The driving transistor 101 is turned off, and the switching transistor 104 is turned on, so that the OLED does not emit light. Within the luminous time period, the scanning signal is at the high level, then the transistor M5 is in the off state. The point Q is electrically connected to the VDD line, that is, the point Q is at the high level. The point /Q is electrically connected to GND. The point /Q and the point g are at the low level. Then the driving transistor 101 continues to be in the off state, the switching transistor 104 continues to be in the on state, and the OLED continues not to emit light.

Due to the leakage current in the digital pixel driving circuit, when the level signal indicates the display module to turn off, the display module still displays, affecting the display efficiency of the display module. In this embodiment, the input terminal of the display module is electrically connected to the input terminal of the short-circuiting module, the output terminal of the display module is electrically connected to the output terminal of the short-circuiting module; thus when the level signal indicates the display module to turn off, the short-circuiting module short-circuits the input terminal and the output terminal of the display module. So that even if there is the leakage current in the digital pixel driving circuit, it may not cause the display module to be driven to display, thus the display module can accurately display according to the indication of the level signal, and the display performance of the digital pixel driving circuit is improved. Moreover, since the display can be strictly performed according to the indication of the level signal, the display effect may not be affected due to the leakage current when an input voltage is increased or decreased. The display effect (such as a brightness value) of the display module can be adjusted by adjusting the input voltage, thereby further improving the accurate control of the display module.

Another embodiment of the present disclosure relates to a digital pixel driving circuit. The embodiment is basically the same as the above mentioned embodiment as shown in FIG. 2 and FIG. 4, and the main difference is that in this embodiment of the present disclosure, another circuit connection manner is provided when a driving transistor 101 and a switching transistor 104 have the same conduction condition, so as to improve the flexibility of the driving transistor.

Figure 5:
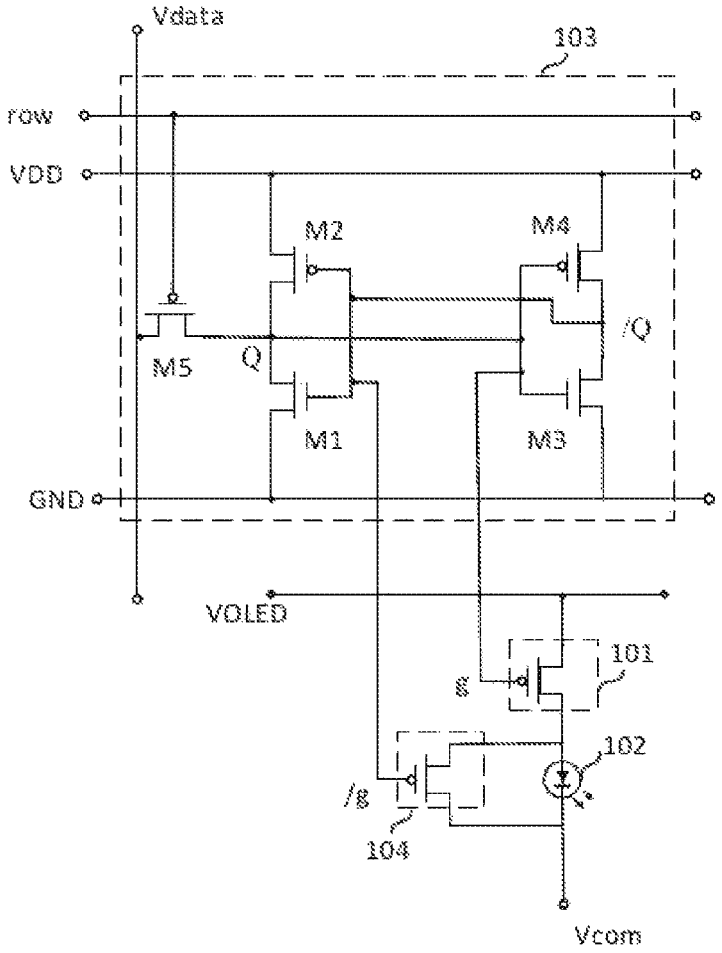
FIG. 5 is a specific circuit schematic diagram of a digital pixel driving circuit according to the present disclosure.

In a specific embodiment, the digital pixel driving circuit is shown in FIG. 5. Here, that the driving transistor is a P-type TFT and the switching transistor is also a P-type TFT is taken as an example for description. A gate of the driving transistor 101 is electrically connected to a first output terminal of a storage module 103 (point Q in FIG. 5), and a gate of the switching transistor 104 is electrically connected to a second output terminal of the storage module 103 (point /Q in FIG. 5). The first output terminal of the storage module 103 outputs a level signal, and the second output terminal of the storage module 103 outputs an inverted level signal opposite to the level signal, where the driving transistor 101 is turned on and the switching transistor 104 is turned off when the level signal indicates the display module 102 to display. When the level signal indicates the display module 102 to display, the level signal controls the driving transistor 101 to drive the display module 102 to display through the gate of the driving transistor 101, and the inverted level signal controls the switching transistor 104 to be turned off through the gate of the switching transistor 104. When the level signal indicates the display module 102 to turn off, the level signal controls the driving transistor 101 to be turned off through the gate of the driving transistor 101, and the inverted level signal controls the switching transistor 104 to be turned on through the gate of the switching transistor 104, so as to short-circuit the input terminal of the display module 102 and the output terminal of the display module 102.

The working principle of the digital pixel driving circuit is explained with a specific example as below. For example, assuming that the number "1" indicates the display module to display, then within a data writing period, a scanning signal is at the low level, and the level signal output from a data line is at the low level. As shown in FIG. 5, a transistor M5 is turned on and the point Q has a low voltage, thus a transistor M4 is turned on and a transistor M3 is turned off. A point /Q is electrically connected to VDD, so that the voltage at the point /Q is equal to the voltage of VDD, i.e., the point /Q is at the high level. Since point g and point Q are the same point with the same voltage, then the voltage of g is low, and the driving transistor 101 is turned on. The voltage at point /g and /Q are the same, so that the switching transistor 104 is turned off and the OLED emits light. Within a luminous time period, the scanning signal is at the high level, then the transistor M5 is in the off state. The point Q is electrically connected to a ground line, that is, the point Q and the point g are at the low level, and the point /g is at the high level, so that the driving transistor 101 continues to be turned on, the switching transistor 104 continues to be in the off state, and the OLED continues to emit light.

The number is "0" indicates the display module to turn off. Within the data writing period, the scanning signal is at the low level, the level signal output from the data line is at the high level, the transistor M5 is turned on and the voltage at point Q is high, thus the transistor M3 is turned on and the transistor M4 is turned off. The point /Q is electrically connected to GND, so that the voltage at the point /Q is equal to the voltage of GND, i.e., the point /Q is at the low level. Then the transistor M1 is turned off and the transistor M2 is turned on, so that the point Q is electrically connected to VDD. The point Q is at the high level, then the voltage of g is at the high level, the driving transistor 101 is turned off, and /g is at the low level, the switching transistor 104 is turned on, so that the OLED does not emit light. Within the luminous time period, the scanning signal is at the high level, then the transistor M5 is in the off state. The point Q is electrically connected to the VDD line, that is, the point Q outputs the level signal, and /Q outputs the inverted level signal, then the driving transistor 101 continues to be in the off state, the switching transistor 104 continues to be in the on state, and the OLED continues not to emit light.

Figure 6:
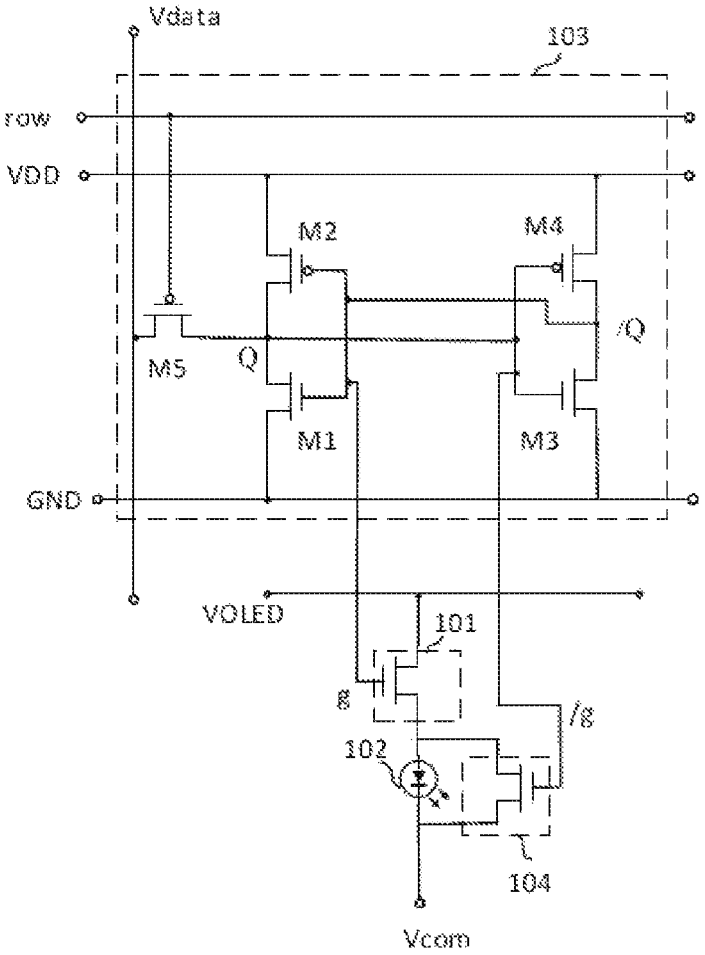
FIG. 6 is an another specific circuit schematic diagram of the digital pixel driving circuit according to the present disclosure.

In another specific embodiment, the digital pixel driving circuit is shown in FIG. 6. Here, that the driving transistor 101 is an N-type TFT and the switching transistor 104 is an N-type TFT is taken as examples for description. The gate of the switching transistor 104 is electrically connected to the first output terminal of the storage module 103 (point Q in FIG. 6), and the gate of the driving transistor 101 is electrically connected to the second output terminal of the storage module 103 (point /Q in FIG. 6). The first output terminal of the storage module 103 outputs the level signal, and the second output terminal outputs the inverted level signal opposite to the level signal. The switching transistor 104 is turned on and the driving transistor 101 is turned off when the level signal indicates the display module 102 to turn off. When the level signal indicates the display module 102 to turn off, the level signal controls the switching transistor 104 to be turned on through the gate of the switching transistor 104 so as to short-circuit the input terminal and the output terminal of the display module 102. The inverted level signal controls the driving transistor 101 to be turned off through the gate of the driving transistor 101. When the level signal indicates the display module 102 to display, the level signal controls the switching transistor 104 to be turned off through the gate of the switching transistor 104, and the inverted level signal controls the driving transistor 101 to drive the display module 102 to display through the gate of the driving transistor 101.

Similarly, the working principle of the digital pixel driving circuits explained with a specific example as below. For example, assuming that the number "1" indicates the display module to display, then within the data writing period, the scanning signal is at the low level, and the voltage of the level signal output from the data line is low. As shown in FIG. 6, the transistor M5 is turned on and the point Q has a low voltage, thus the transistor M4 is turned on and the transistor M3 is turned off. The point /Q is electrically connected to VDD, so that the voltage at the point /Q is equal to the voltage of VDD, i.e., the point /Q is at the high level. Since point g and point /Q are the same point with the same voltage, the point g is at the high level. The driving transistor 101 is turned on, and the point /g is at the low level, the switching transistor 104 is turned off, so that the OLED emits light. Within the luminous time period, the scanning signal is at the high level, then the transistor M5 is in the off state. The point Q is electrically connected to the ground line, that is, the point Q is at the low level, the point g is at the high level, and the point /g is at the low level, then the driving transistor 101 continues to be turned on, the switching transistor 104 continues to be in the off state, and the OLED continues to emit light.

The number "0" indicates the display module to close. Within the data writing period, the scanning signal is at the low level, the level signal output from the data line is at the high level, the transistor M5 is turned on and the point Q has a high voltage, thus the transistor M3 is turned on and the transistor M4 is turned off. The point /Q is electrically connected to GND, so that the voltage at the point /Q is equal to the voltage of GND, i.e., the point /Q is at the low level. The driving transistor 101 is turned off. Point Q is at the high level, the switching transistor 104 is turned on, so that the OLED does not emit light. Within the luminous time period, the scanning signal is at the high level, then the transistor M5 is in the off state. The point Q is electrically connected to the VDD line, that is, the point Q is at the high level. The point /Q is electrically connected to GND, the point /Q and the point g are at the low level, so the driving transistor 101 continues to be in the off state. The point /g is at the high level, the switching transistor 104 continues to be in the on state, and the OLED continues not to emit light.

The digital pixel driving circuit provided by this embodiment provides several circuit connection manners when the conduction condition of the driving transistor and the conduction condition of the switching transistor are the same, so that the type of the driving transistor and the switching transistor may be selected according to actual needs, and the flexibility and applicability of the digital pixel driving circuit are improved.

Figure 7:
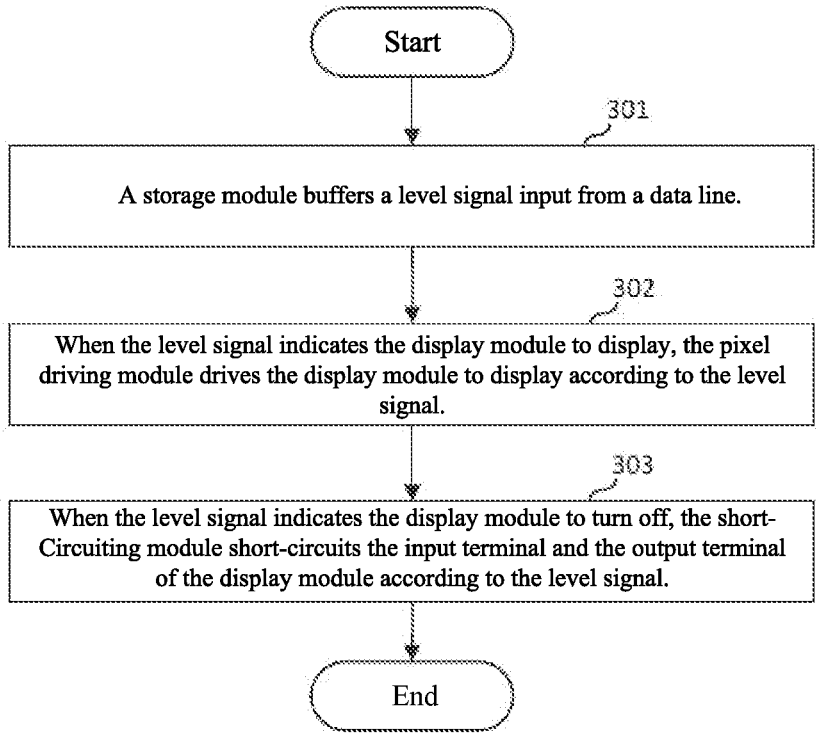
FIG. 7 is a specific flow schematic diagram of a digital pixel driving method according to the present disclosure.

An embodiment of the present disclosure relates to a digital pixel driving method, which is applied to the digital pixel driving circuit as shown in the above mentioned embodiment as shown in FIG. 2 and FIG. 3. In this embodiment, the pixel driving method is described in conjunction with the pixel circuit of FIG. 2. The specific flow of the pixel driving method is shown in FIG. 7.

In step 301, a storage module buffers a level signal input from a data line.

Specifically, for the circuit structure shown in FIG. 2, the level signal input from the data line may be buffered by a SRAM circuit structure, and output through the first output terminal of the storage module. The second output terminal of the storage module outputs an inverted level signal. The level signal is opposite to the inverted level signal.

In step 302, when the level signal indicates the display module to display, the pixel driving module drives the display module to display according to the level signal.

Specifically, as shown in FIG. 2, the pixel driving module is the driving transistor 101. The driving transistor 101 is the P-type TFT, that is, the driving transistor is turned on when the gate of the driving transistor is at a low level. A short-circuiting module 104 is a switching transistor 104. The switching transistor 104 is the N-type TFT, that is, the switching transistor is turned on when the gate of the switching transistor is at a high level.

The working principle of the digital pixel driving circuit when the level signal indicates the display module to display is described below with a specific example. Assuming that in the case of a timing with a number of "1", within a data writing period, a scanning signal is at a low level and the level signal output from the data line is at the low level. Then the first output terminal of the storage module outputs a low level signal, and the second output terminal of the storage module 103 outputs a high level signal. The low level signal controls the driving transistor 101 to be in an on state. At the same time, the low level signal controls the switching transistor 104 to be in an off state and an OLED emits light. Within a luminous time period, the scanning signal is at the high level and the level signal output from the data line is at the low level. At this time, the storage module outputs the level signal stored in the data writing period. That is, at this time, the first output terminal of the storage module continues to output the low level signal and the second output terminal of the storage module 103 outputs the high level signal. So the low level signal continues to control the driving transistor 101 to be in the on state, and at the same time, the low level signal controls the switching transistor 104 to continue to be in the off state and the OLED emits light.

In step 303, when the level signal indicates the display module to turn off, the short-circuiting module short-circuits the input terminal and the output terminal of the display module according to the level signal.

The working principle of the digital pixel driving circuit when the level signal indicates the display module to display is described below with a specific example. Assuming that in the case of the timing with the number of "0", within the data writing period, the scanning signal is at the low level and the level signal output by the data line is at the high level. Then the first output terminal of the storage module outputs the high level signal, and the second output terminal of the storage module outputs the low level signal. The high level signal output by the first output terminal of the storage module controls the driving transistor 101 to be in the off state, and at the same time, the high level signal controls the switching transistor 104 to be in the on state and the OLED does not emit light. Within the luminous time period, the scanning signal is at the high level and the level signal output from the data line is at the high level. At this time, the storage module outputs the level signal stored in the data writing period. That is, at this time, the first output terminal of the storage module continues to output the high level signal and the second output terminal of the storage module outputs the low level signal. Then the high level signal continues to control the driving transistor 101 to be in the off state, and at the same time, the high level signal controls the switching transistor 104 to continue to be in the on state, thus the input terminal and the output terminal of the OLED is shorted, and the OLED does not emit light.

The steps of the above methods are divided only for the sake of clarity of description, and may be combined into one step or split into multiple steps. As long as the same logical relationship is included, all of them are within the scope of protection of the present disclosure. It is within the protection scope of the present disclosure to add irrelevant modifications to the algorithm or process or to introduce irrelevant designs without changing the core design of its algorithm and process.

This embodiment is a method embodiment corresponding to the embodiment as shown in FIG. 2 and FIG. 3, and this embodiment may be implemented in cooperation with the embodiment as shown in FIG. 2 and FIG. 3. The relevant technical details mentioned in the embodiment as shown in FIG. 2 and FIG. 3 are still valid in this embodiment, and are not repeated here in order to reduce repetition. Correspondingly, the relevant technical details mentioned in this embodiment may also be applied in the embodiment as shown in FIG. 2 and FIG. 3.

Figure 8:
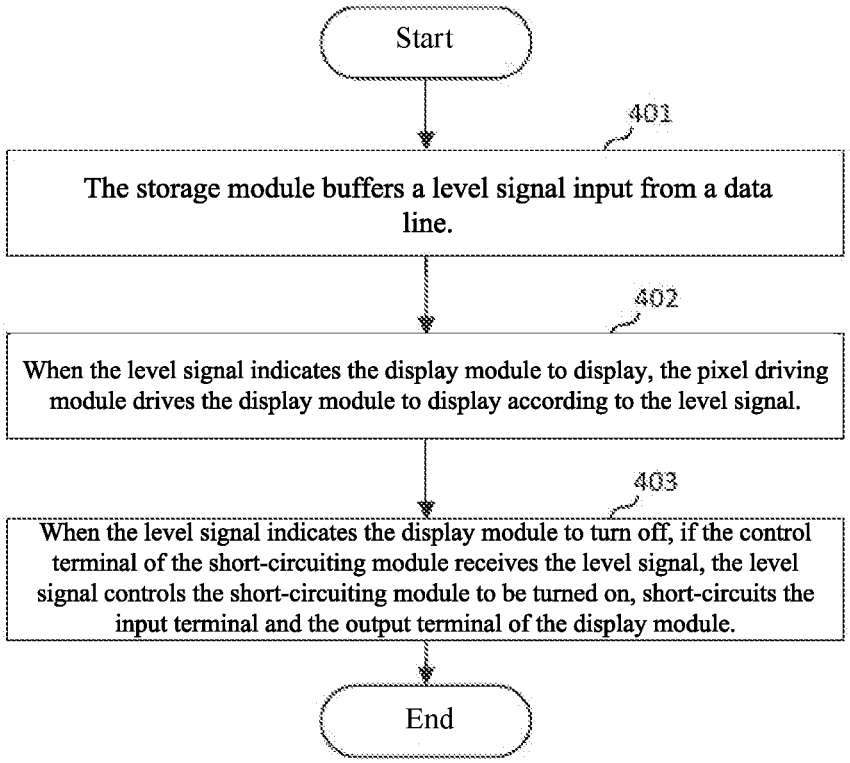
FIG. 8 is a specific flow schematic diagram of a digital pixel driving method according to the present disclosure.
Figure 9:
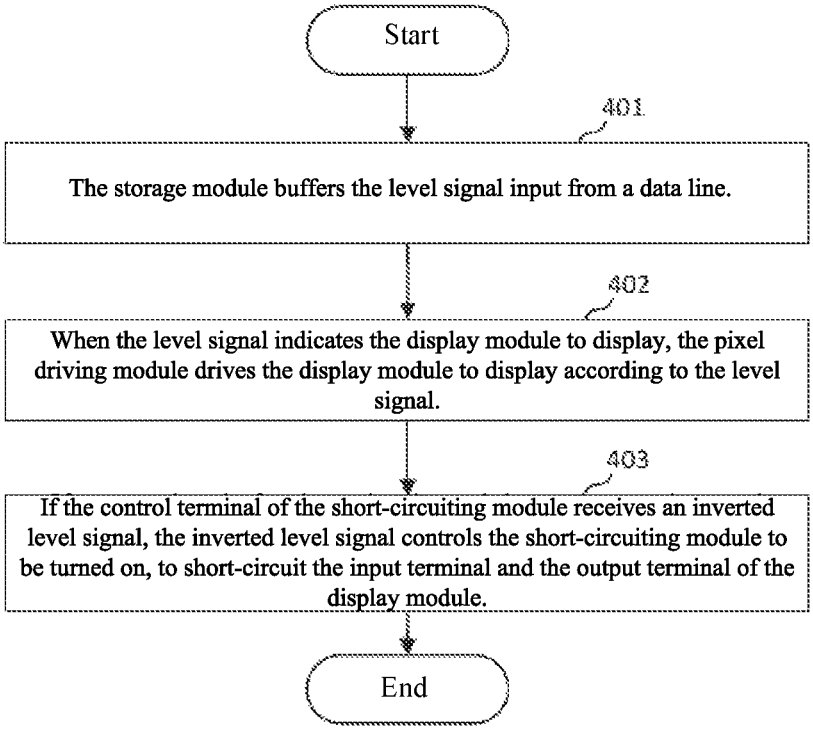
FIG. 9 is a schematic diagram of a specific flow of another digital pixel driving method according to the present disclosure.

Another embodiment of the present disclosure relates to a digital pixel driving method. The embodiment further refines step 303 in the above mentioned embodiment as shown in FIG. 7. The specific flow of the pixel driving method is shown in FIG. 8 or FIG. 9.

In step 401, the storage module buffers a level signal input from a data line.

In step 402, when the level signal indicates the display module to display, the pixel driving module drives the display module to display according to the level signal.

In step 403, when the level signal indicates the display module to turn off, if the control terminal of the short-circuiting module receives the level signal, the level signal controls the short-circuiting module to be turned on, short-circuits the input terminal and the output terminal of the display module.

Specifically, the short-circuiting module is a switching transistor and the pixel driving module is a driving transistor. If the driving transistor and the switching transistor have different conduction conditions, the structure of the digital pixel driving circuit shown in FIG. 2 may be adopted, and if the driving transistor and the switching transistor have the same conduction condition, the structure of the digital pixel driving circuit shown in FIG. 6 may be adopted.

If the circuit structure in FIG. 2 is adopted, both the driving transistor 101 and the switching transistor 104 are electrically connected to the first output terminal of the storage module 103. In FIG. 2, the driving transistor 101 is turned on under a low level signal, and the switching transistor 104 is turned on under a high level signal. If that the level signal is at the low level indicates the display module 102 to display, when the level signal indicates the display module 102 to display, the first output terminal of the storage module 103 outputs the level signal. The level signal controls the driving transistor 101 to be turned on through the gate of the driving transistor 101, thereby driving the display module 102 to display. At the same time, the level signal controls the switching transistor 104 to be in an off state through the gate of the switching transistor 104, then the display module 102 displays. If the level signal indicates the display module 102 to turn off, the level signal controls the driving transistor 101 to be in the off state though the gate of the driving transistor 101. At the same time, the level signal controls the switching transistor 104 to be in an on state through the gate of the switching transistor 104, thereby short-circuiting the input terminal and the output terminal of the display module 102. The specific working principle is approximately the same as that of FIG. 2 i and will not be described here.

If the digital pixel driving circuit shown in FIG. 6 is adopted, the gate of the driving transistor 101 is electrically connected to the second output terminal of the storage module and the gate of the switching transistor 104 is electrically connected to the first output terminal of the storage module. In FIG. 6, the driving transistor 101 is turned on under the low level signal, and the switching transistor 104 is turned on under the high level signal. If that the level signal is at the low level indicates the display module 102 to display, when the level signal indicates the display module 102 to display, the first output terminal of the storage module 103 outputs the level signal. The driving transistor 101 is an N-type TFT and the switching transistor 104 is an N-type TFT. When the level signal indicates the display module 102 to display, the level signal is at the low level, and then the level signal controls the switching transistor 104 to be in the off state through the gate of the switching transistor 104. An inverted level signal is at the high level, and the inverted level signal controls the driving transistor 101 to be turned on, and then the display module 102 displays. When the level signal indicates the display module 102 to turn off, the level signal is at the high level. The level signal controls the switching transistor 104 to be in the on state through the gate of the switching transistor 104. The inverted level signal is at the low level, then the inverted level signal controls the switching transistor 104 to be in the off state and the display module 102 turns off.

If the driving transistor and the switching transistor have different conduction conditions, the digital pixel driving circuit may also adopt the circuit structure shown in FIG. 4. If the driving transistor and the switching transistor have the same conduction condition, the circuit structure shown in FIG. 5 may also be adopted. Then the specific flow of the digital pixel driving method is shown in FIG. 9.

In step 401, the storage module buffers the level signal input from the data line.

In step 402, when the level signal indicates the display module to display, the pixel driving module drives the display module to display according to the level signal.

In step 403, if the control terminal of the short-circuiting module receives an inverted level signal, the inverted level signal controls the short-circuiting module to be turned on, to short-circuit the input terminal and the output terminal of the display module.

Specifically, if the circuit structure shown in FIG. 4 is adopted, when the level signal indicates the display module 102 to display, the gate of the switching transistor 104 controls the switching transistor 104 to be turned off by the inverted level signal. When the level signal indicates the display module 102 to turn off, the gate of the switching transistor 104 controls the switching transistor 104 to be turned on by the inverted level signal to short-circuit the input terminal and the output terminal of the display module 102. The driving transistor 101 is turned on under the high level signal, and the switching transistor 104 is turned on under the low level signal. If the display module 102 is indicated to display when the level signal is at the low level, the first output terminal of the storage module 103 outputs the low level signal. The inverted level signal is at the high level, so that the inverted level signal controls the driving transistor 101 to be in an on state. At the same time, the high level signal causes the switching transistor 104 to be in an off state. If the display module 102 is indicated to turn off when the level signal is at the high level, the first output terminal of the storage module 103 outputs the high level signal. The level signal is at the high level, and the inverted level signal is at the low level. The inverted level signal controls the driving transistor 101 to be in the off state, and the inverted level signal causes the switching transistor 104 to be in the on state, thereby short-circuiting the input terminal and the output terminal of the display module 102.

If the circuit structure shown in FIG. 5 is adopted, the driving transistor 101 is turned on under the high-level signal, and the switching transistor 104 is turned on under the high-level signal. If the display module 102 is indicated to display when the level signal is at the low level, the first output terminal of the storage module 103 outputs the low level signal, thus driving the driving transistor 101 to be turned on. At the same time, the inverted level signal is at the high level, and the inverted level signal causes the switching transistor 104 to be in the off state. If the display module 102 is indicated to turn off when the level signal is at the high level, then the high level signal output by the first output terminal of the storage module 103 controls the driving transistor 101 to be in the off state. While the inverted level signal is at the low level, then the inverted level signal controls the switching transistor 104 to be in the on state, thereby short-circuiting the input terminal and the output terminal of the display module 102.

Steps 401 to 402 in FIG. 8 and FIG. 9 in this embodiment are substantially the same as steps 301 to 302 in the above embodiment as shown in FIG. 7, and are not repeated in this embodiment.

The digital pixel driving method provided in this embodiment determines that the short-circuiting module short-circuits the input terminal and the output terminal of the display module under the control of the level signal or the inverted level signal according to the type of the signal received by the control terminal of the short-circuiting module.

Those skilled in the art may appreciate that the aforementioned embodiments are specific embodiments for implementing the present disclosure. In practical applications, however, various changes may be made in the forms and details of the specific embodiments without departing from the spirit and scope of the present disclosure.

What is claimed is:

1. A digital pixel driving circuit, comprising:

a display module, a storage module, configured to buffer a level signal input from a data line and output the level signal;

a pixel driving module, wherein an input terminal of the pixel driving module is electrically connected to a display voltage, an output terminal of the pixel driving module is electrically connected to an input terminal of the display module, and a control terminal of the pixel driving module is electrically connected to one of output terminals of the storage module;

a short-circuiting module, wherein an input terminal of the short-circuiting module is electrically connected to the input terminal of the display module, an output terminal of the short-circuiting module is electrically connected to an output terminal of the display module, and a control terminal of the short-circuiting module is electrically connected to one of the output terminals of the storage module;

wherein, the short-circuiting module is configured to short-circuit the input terminal of the display module and the output terminal of the display module, when the level signal indicates the display module to turn off; the pixel driving module is configured to drive the display module to display, when the level signal indicates the display module to display, wherein the short-circuiting module is a switching transistor and the pixel driving module is a driving transistor, wherein when the driving transistor and the switching transistor have different conduction conditions, a gate of the driving transistor is electrically connected to a first output terminal or a second output terminal of the storage module, a gate of the switching transistor is electrically connected to the first output terminal or the second output terminal of the storage module; the first output terminal of the storage module is configured to output the level signal, and a second output terminal of the storage module is configured to output an inverted level signal opposite to the level signal.

2. The digital pixel driving circuit of claim 1, wherein when the driving transistor and the switching transistor have the same conduction condition, a gate of the driving transistor is electrically connected to a first output terminal of the storage module, and a gate of the switching transistor is electrically connected to a second output terminal of the storage module;

wherein the first output terminal of the storage module is configured to output the level signal and the second output terminal is configured to output the inverted level signal opposite to the level signal.

3. The digital pixel driving circuit of claim 1, wherein when the driving transistor and the switching transistor have the same conduction condition, a gate of the switching transistor is electrically connected to a first output terminal of the storage module, and a gate of the driving transistor is electrically connected to a second output terminal of the storage module;

wherein the first output terminal of the storage module is configured to output the level signal and the second output terminal of the storage module is configured to output the inverted level signal opposite to the level signal.

4. The digital pixel driving circuit of claim 1, wherein the storage module adopts a circuit structure of a static random access memory (SRAM);

an input terminal of the storage module is electrically connected to the data line and a scanning line; and the storage module is configured to store the level signal according to a scanning signal output from the scanning line; or the storage module is configured to output the level signal according to the scanning signal and to output the inverted level signal opposite to the level signal.

5. The digital pixel driving circuit of claim 1, wherein the driving transistor is a P-type thin film transistor or an N-type thin film transistor; and the switching transistor is a P-type thin film transistor or an N-type thin film transistor.

6. The digital pixel driving circuit of claim 1, wherein the display module is an organic light-emitting diode or a light emitting diode.

7. A digital pixel driving method, applied to the digital pixel driving circuit of claim 1, wherein, the digital pixel driving method comprises:

buffering, by the storage module, a level signal input from a data line;

driving, by the pixel driving module, the display module to display when the level signal indicates the display module to display; and short-circuiting, by the short-circuiting module, the input terminal and the output terminal of the display module, when the level signal indicates the display module to turn off, wherein the short-circuiting module is a switching transistor and the pixel driving module is a driving transistor;

the short-circuiting, by the short-circuiting module, the input terminal and the output terminal of the display module, when the level signal indicates the display module to turn off, comprising:

if the driving transistor and the switching transistor have different conduction conditions and the switching transistor is turned off when the level signal indicates the display module to display, controlling the switching transistor to be turned off, by the level signal through a gate of the switching transistor, when the level signal indicates the display module to display; and controlling the switching transistor to be turned on to short-circuit the input terminal and the output terminal of the display module, by the level signal through the gate of the switching transistor, when the level signal indicates the display module to turn off.

8. The digital pixel driving method of claim 7, wherein the short-circuiting module is a switching transistor and the pixel driving module is a driving transistor;

the short-circuiting, by the short-circuiting module, the input terminal and the output terminal of the display module when the level signal indicates the display module to turn off, comprising:

if the driving transistor and the switching transistor have different conduction conditions and the switching transistor is turned on when the level signal indicates the display module to display, controlling the switching transistor to be turned off, by an inverted level signal opposite to the level signal through a gate of the switching transistor, when the level signal indicates the display module to display; and controlling the switching transistor to be turned on to short-circuit the input terminal and the output terminal of the display module, by the inverted level signal opposite to the level signal through the gate of the switching transistor, when the level signal indicates the display module to turn off.

9. The digital pixel driving method of claim 7, wherein the short-circuiting module is a switching transistor and the pixel driving module is a driving transistor;

the short-circuiting, by the short-circuiting module, short-circuits the input terminal and the output terminal of the display module when the level signal indicates the display module to turn off, comprising:

if the driving transistor and the switching transistor have the same conduction condition and the switching transistor is turned on when the level signal indicates the display module to display, when the level signal indicates the display module to display, controlling the driving transistor to drive the display module to display, by the level signal through a gate of the driving transistor and controlling the switching transistor to be turned off, by an inverted level signal opposite to the level signal through a gate of the switching transistor; and when the level signal indicates the display module to turn off, controlling the driving transistor to be turned off, by the level signal through the gate of the driving transistor and controlling the switching transistor to be turned on to short-circuit the input terminal of the display module and the output terminal of the display module, by the inverted level signal through the gate of the switching transistor.

10. The digital pixel driving method of claim 7, wherein the short-circuiting module is a switching transistor and the pixel driving module is a driving transistor;

the short-circuiting, by the short-circuiting module, short-circuits the input terminal and the output terminal of the display module when the level signal indicates the display module to turn off when the level signal indicates the display module to turn off, comprising:

if the driving transistor and the switching transistor have the same conduction condition and the switching transistor is turned on when the level signal indicates the display module to turn off, when the level signal indicates the display module to turn off, controlling the switching transistor to be turned on to short-circuit the input terminal and the output terminal of the display module, by the level signal through a gate of the switching transistor and controlling the driving transistor to be turned off, by an inverted level signal opposite to the level signal through the gate of the driving transistor; and when the level signal indicates the display module to display, controlling the switching transistor to be turned off, by the level signal through the gate of the switching transistor and controlling the driving transistor to drive the display module to display, by the inverted level signal through the gate of the driving transistor.

* * * * *